US005518233A

United States Patent [19]

Williams

[11] Patent Number: 5,518,233

[45] Date of Patent: May 21, 1996

[54] ANCHOR FOR A BASKETBALL GOAL

[76] Inventor: Linkwood Williams, 1179 E. Parkway South, Memphis, Tenn. 38114

[21] Appl. No.: 527,447

[22] Filed: Sep. 13, 1995

[51] Int. Cl.[6] ..... A63B 63/08

[52] U.S. Cl. ..... 273/1.5 R; 248/218.4; 248/230.8; 248/315; 248/346.01; 248/539

[58] Field of Search ..... 273/1.5 R, 1.5 A; 248/519, 523, 534, 535, 539–541, 205.1, 218.4, 219.1, 230.1, 230.8, 315, 346.01, 346.5, 346.03, 910

[56] References Cited

U.S. PATENT DOCUMENTS

| | | | |
|---|---|---|---|
| 3,181,849 | 5/1965 | Mithcell | 267/1 |
| 4,964,601 | 10/1990 | Dishman | 7/14 |
| 5,158,281 | 10/1992 | Williams | 63/8 |

*Primary Examiner*—Paul E. Shapiro
*Attorney, Agent, or Firm*—Walker, McKenzie & Walker

[57] ABSTRACT

An anchor for anchoring the post of a basketball goal to a container. The anchor includes a portion of a vehicle tire that has been modified so that the tire has been severed transversely to provide a pair of ends and a major portion of the sidewalls of the tire have been removed to provide partial sidewalls respectively having holes therethrough adapted to receive the post of a basketball goal. A tightener extends between the pair of ends for selectively drawing the ends together to tighten the anchor around a container. A modified embodiment includes a tire of a right size to snugly fit around a container or a portion thereof and the tire is complete except for aligned holes respectively in the opposite sidewalls of the tire and adapted to receive the post of a basketball goal. A specially designed container is disclosed that is adapted to be used with the modified embodiment.

11 Claims, 2 Drawing Sheets

ANCHOR FOR A BASKETBALL GOAL

BACKGROUND OF THE INVENTION

1. Field of the Invention

The present invention relates, in general, to anchors for anchoring the post of a basketball goal to a container.

2. Information Disclosure Statement

As is known, there are many old and worn out vehicle tires that are discarded each year, resulting in the problem of what to do with the vast numbers that are accumulated. Also, there is a need for an inexpensive and convenient way to anchor a basketball goal post that is portable.

It is therefore desirable to have an improved, convenient and inexpensive way to anchor such a post for a basketball goal while at the same time providing a use for old and worn out tires.

A preliminary patentability search in Class 273 subclass 1.5, and Class 248, subclasses 231 and 910 produced the following patents, some of which may be relevant to the present invention: Mitchell, U.S. Pat. No. 3,181,849 issued May 4, 1965, and Dishman, U.S. Pat. No. 4,964,601 issued Oct. 23, 1990.

Additionally, my U.S. Pat. No. 5,158,281, issued Oct. 27, 1992 describes a portable basketball goal assembly having various anchors for supporting the post of a basketball goal assembly.

SUMMARY OF THE INVENTION

The present invention is an improvement of the apparatus disclosed and claimed in my heretofore mentioned U.S. Pat. No. 5,158,281, and is directed towards providing an inexpensive and convenient way to anchor a basketball goal post.

It is an object of the present invention to provide a use for old and worn out vehicle tires with a minimum of modification of the tires.

A further object of the present invention to provide an anchor for a basketball goal post that is easy to construct.

A further object is to provide such an anchor that can be constructed by severing a tire transversely to leave a first end and a second end spaced from the first end, by removing a portion of the sidewall of the tire leaving a first partial sidewall portion, by cutting a first hole in said first partial sidewall portion, and by attaching tightening means spanning the space between said first and second ends for selectively drawing said first end and said second ends rewards one another.

A further object is to provide a modified embodiment of the present invention which includes providing in the sidewalls of a tire a first hole and a second hole opposite said first hole adapted to receive the post of a basketball goal and with the tire encircling a container or a portion of the container having an outside diameter slightly larger than the inside diameter of the tire so that the container is tightly held by the anchor to support the post.

A further object is to provide a specially designed container for use with the modified embodiment of the present invention.

DESCRIPTION OF THE PREFERRED EMBODIMENT

Figure 1:
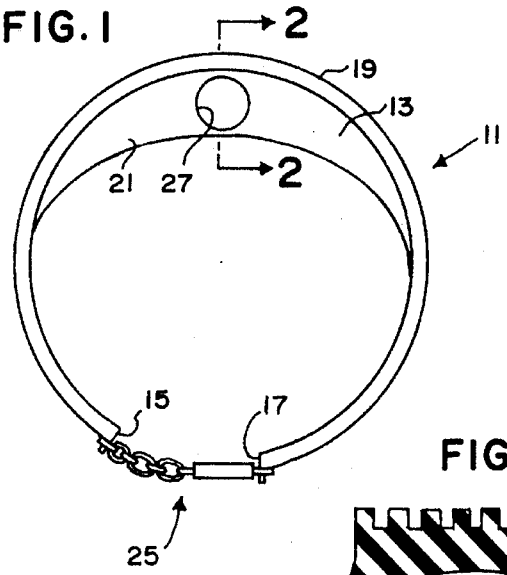
FIG. 1 is a top plan view of the anchor of the present invention.

Referring to FIGS. 1–6, anchor 11 of the present invention includes in general a non-continuous vehicle tire portion 13 including a first end 15 and a second end 17 detached or spaced from first end 115, a tread portion 19, a first partial sidewall portion 21 joined with tread portion 19 on one side of tire portion 13, and a second partial sidewall portion 23 joined with tread portion 19 on the opposite side of tire portion 13 from first partial sidewall portion 21, and a tightener or tightening means 25 respectively attached to first end 15 and second end 17 spanning the space between second end 17 and first end 15 for selectively drawing second end 17 and first end 15 towards one another. For clarity, the portions 21 and 23 are herein referred to as side wall portions because, as will be understood from the following description of the construction of the anchor 13, the portions 21 and 23 are portions of the sidewall of the original tire, although in the use of the anchor 11 the portions 21 and 23 will be oriented respectively at the top and the bottom of the anchor rather than on the sides, as will be understood from the description of the use of anchor 11 to follow later in the specification.

In constructing the anchor 11 of the present invention, the starting point is preferably a conventional rubber tire, not shown, but well known to those skilled in the art which is preferably an old tire, although any tire whether old or new may be used and which has the usual road contacting or tread portion that may or may not have any actual tread left after long use, and which has the usual side wall portions on opposite sides of the tire. Using such a conventional tire as a starting point, the tire is severed transversely to leave first end 15 and second end 17 preferably spaced from one another. If desired, depending on the circumference of anchor 11 to be made, any amount of the tire may be removed to provide the desired amount of space between first end 15 and second end 17.

Preferably a second step in constructing the anchor 11 is the removal of portions of the sidewalls of the original tire, by any suitable means, as by cutting or the like, to leave first partial sidewall portion 21 that is joined with tread portion 19 and second partial sidewall portion 23 that is joined with tread portion 19 on the opposite side of anchor 11 from first partial sidewall portion 21. First partial sidewall portion 21 is preferably though not necessarily of the shape best shown in FIG. 1, i.e., arcuate in shape and with less than half of the original sidewall of the original tire remaining. Second partial sidewall portion 23 is preferably substantially identical to first partial sidewall portion 21 in all respects, i.e., in position, outline, and size, and is in alignment with first partial sidewall portion 21. Thus, a bottom view of anchor 11 would have substantially the same appearance as FIG. 1.

Preferably a third step in constructing anchor 11 is providing a pair of aligned holes respectively in first partial sidewall portion 21 and second partial sidewall portion 23, i.e., a first hole 27 through first partial sidewall 21 and a second hole 29 through second partial sidewall portion 23. The holes 27, 29 are preferably identical in size, shape and position, and are in alignment with one another. The holes 27, 29 are preferably round and of a size to closely receive the post of a basketball goal assembly with which the anchor 11 is adapted to be used. It will be understood that one of the partial sidewall portions 21 or 23 may be omitted along with its corresponding holes 27 or 29 may be omitted without departing from the spirit and scope of the present invention.

Lastly, the final step in constructing anchor 11 is to provide the anchor with tightening means 25, which preferably includes in general a turnbuckle 31 and a chain 33. Turnbuckle 31 may be of the conventional construction shown, which includes an elongated body portion 35 and a pair of threaded rods 37, 39 respectively threadedly engaged in the usual manner in threaded apertures in the opposite ends of body portion 35. The rods 37, 39 in the usual manner respectively have threads of the opposite pitch so that when body portion 35 is turned in one direction the rods 37, 39 will move axially away from one another and when turned in the opposite direction will move axially towards one another. Rod 37 is preferably provided on the distal end thereof with a hook 41 adapted to hook into a selected link of chain 33. Chain 33 is fixedly attached to tread portion 19 adjacent first end 15 by suitable means, as for example, a bolt 43 extending through a hole 45 in tread portion 19 adjacent first end 15 and held therein by a nut 47. Rod 39 is preferably provided on the distal end thereof with an eyelet 49 and is fixedly attached to tread portion 19 adjacent second end 17 by suitable means, as for example, a bolt 51 extending through a hole 53 in tread portion 19 adjacent second end 17 and held therein by a nut 55.

It will be understood that the order of the above enumerated steps may be changed without departing from the spirit and scope of the present invention.

Figure 4:
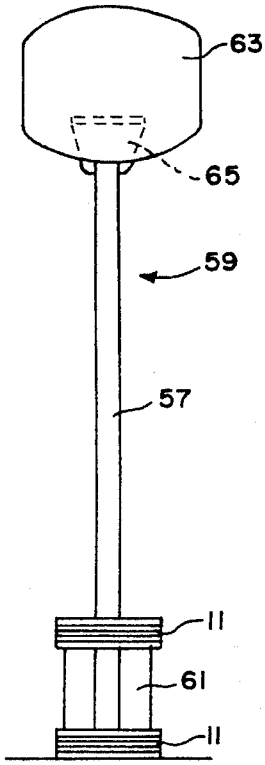
FIG. 4 is a front elevational view of the anchor of the present invention on a reduced scale shown anchoring the post of a basketball goal.
Figure 2:
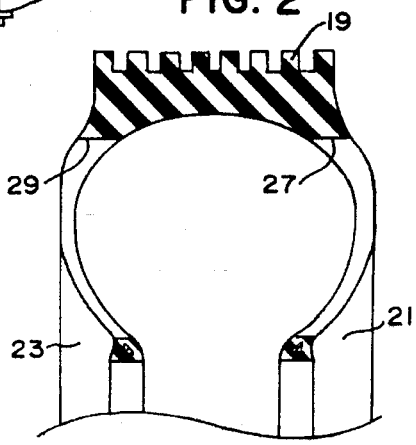
FIG. 2 is an enlarged sectional view taken as on the line 2–2 of FIG. 1.
Figure 3:
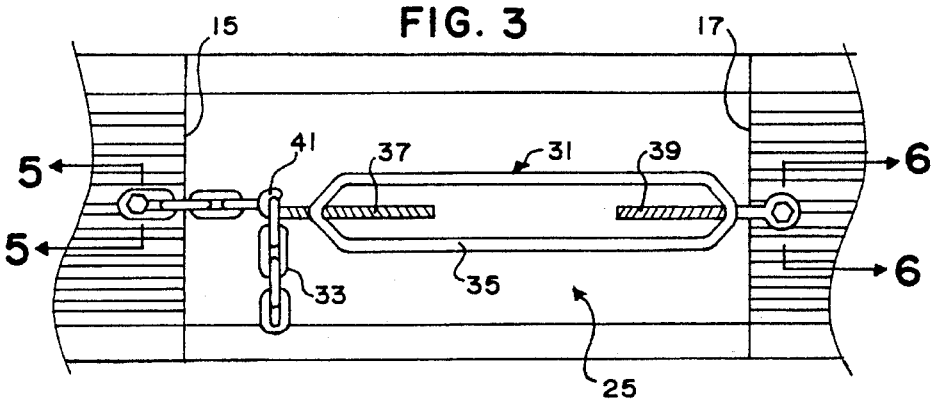
FIG. 3 is an enlarged fragmentary rear elevational view of the anchor of the present invention.
Figure 5:
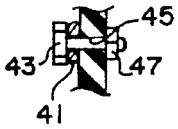
FIG. 5 is a fragmentary sectional view taken as on the line 5–5 of FIG. 3.
Figure 6:
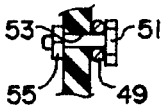
FIG. 6 is a fragmentary sectional view taken as on the line 6–6 of FIG. 3.

The use of anchor 11 is illustrated in FIG. 4 wherein it will be seen that two anchors 11 are used for anchoring the post 57 of a basketball goal 59 to a container 61. The basketball goal 57 in addition to the post 57 includes the usual backboard 63 and net 65. Container 61 may be either a drum, such as an industrial drum, a rain barrel, garbage canister, or the like which is filled with a suitable material, such as water, or the like. One of the anchors 11 is placed around container 61 near the bottom thereof and the other anchor 11 is placed around container 61 near the top thereof. The lower end of post 57 is placed through the holes 27, 29 in the anchor 11 that is near the top of container 61 and then the lower end of post 57 is placed through the holes 27, 29 in the anchor 11 that is near the bottom of container 61. Once the post 57 is in place the body portions 35 of tightening means 25 of the upper and lower anchors 11 are turned in the proper direction to cause turnbuckles 31 to draw the first end 15 and the second end 17 of the respective tire portions 13 towards one another and tighten the anchors 11 around the container 61 to secure post 57 in position.

It will be understood that only one anchor 11 may be used to secure post 57 without departing from the spirit and scope of the present invention.

Figure 7:
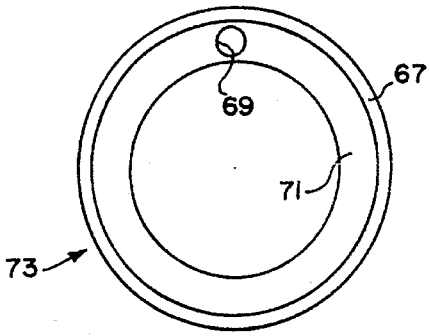
FIG. 7 is a plan view of a modified embodiment of the present invention.

An alternate embodiment is shown in FIG. 7, wherein it will be seen that instead of cutting the tire 67 transversely and removing portions of the sidewalls thereof, tire 67 is maintained intact except for holes 69 (only one of which is shown) through the sidewalls 71 (only one of which is shown) of tire 67. The holes 69 are in alignment and perform the same function as holes 27, 29 of the primary embodiment. It will be understood, however, that the alternate embodiment anchor 73 shown in FIG. 7 functions in the same manner as anchor 11 except that anchor 73 does not have the capability of being adjusted for tightness around a container and will not fit various sizes of containers like anchor 11. Thus, anchor 73 will substantially snugly fit only a specially designed container or one having a particular circumference of the right size.

Figure 8:
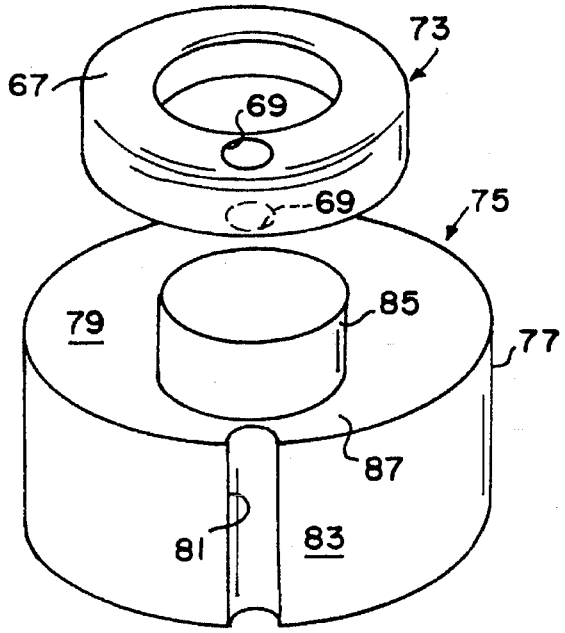
FIG. 8 is a somewhat diagrammatic perspective view of a specially designed container for use with the modified embodiment of the present invention and with the modified embodiment being shown in position to be placed onto the specially designed container.
Figure 9:
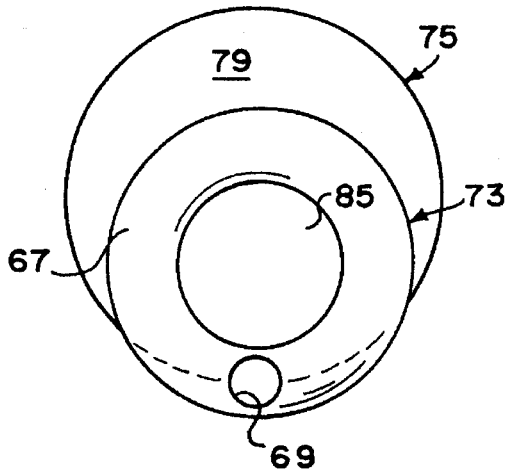
FIG. 9 is a top plan view of that shown in FIG. 8 but with the modified embodiment being shown in position over the projection of the specially designed container.

A specially designed container 75 is shown in FIGS. 8 & 9 for use with anchor 73. Container 75 includes a waterproof or watertight base 77 that is preferably cylindrical in shape and filled with a suitable material, such as water or the like. Container 75 has a top surface 79 and a recess 81 in the front surface 83 of the container. Recess 81 is preferably either semi-circular or V-shaped in cross section and extends vertically through container 75 and through the top and bottom of the container. Recess 81 is preferably of a size to permit reception of the lower portion of goal post 57 of basketball goal 59 to help stabilize the goal post.

Container 75 also includes a preferably cylindrical projection 85 fixedly attached to top surface 79 by suitable well known means and extending upwardly from top surface 79 for receiving a tire such as tire 67 therearound. Projection 85 is preferably smaller in diameter than base 77 to establish a ledge 87 on top surface 79 around projection 85 for providing a place for tire 67 to rest. The outside diameter of projection 85 is such that the tire 67 will fit snugly over projection 85. Projection 85 is mounted in an offset position relative to the vertical centerline of base 77 and towards recess 81 so that tire 67 can be placed over projection 85 with holes 69 aligned with recess 81 whereby the lower portion of post 57 of basketball goal 59 can be inserted downwardly through holes 69 and recess 81 to stabilize goal post 57.

Although the present invention has been described and illustrated with respect to a preferred embodiment and a preferred use therefor, it is not to be so limited since modifications and changes can be made therein which are within the full intended scope of the invention.

I claim:

1. An anchor for anchoring the post of a basketball goal to a container, said anchor comprising:

(a) a non-continuous vehicle tire portion including a first end and a second end, said tire portion including:

i. a tread portion, ii. a first partial sidewall portion joined with said tread portion, and, iii. a first hole provided in said first partial sidewall portion for receiving the post of a basketball goal; and (b) tightening means respectively attached to said first end and said second end for selectively drawing said second end and said first end towards one another.

2. The anchor of claim 1 in which said vehicle tire portion includes a second partial sidewall portion spaced from said first partial sidewall portion and joined with said tread portion on the opposite side of said tread portion from said first sidewall portion, and includes a second hole provided in said second partial sidewall portion in alignment with said first hole for receiving the post of a basketball goal.

3. In combination, a basketball goal including a post, a container, and at least one anchor encircling said container for anchoring said post to said container, said anchor comprising:

(a) a non-continuous vehicle tire portion including a first end and a second end spaced from said first end, said tire portion including:
  i. a tread portion,
  ii. a first partial sidewall portion joined with said tread portion, and,
  iii. a first hole provided in said first partial sidewall portion receiving said post of said basketball goal; and (b) tightening means respectively attached to said first end and said second end and spanning the space between said second end and said first end for selectively drawing said second end and said first end towards one another to tighten said anchor on said container.

4. The combination of claim 3 in which a pair of said anchors are included in said combination with said pair of anchors being spaced vertically on said container.

5. The combination of claim 3 in which said vehicle tire portion includes a second partial sidewall portion spaced from said first partial sidewall portion and joined with said tread portion on the opposite side of said tread portion from said first sidewall portion, and includes a second hole provided in said second partial sidewall portion in alignment with said first hole receiving said post of said basketball goal.

6. In combination, a basketball goal including a post, a container having an outside diameter, and an anchor for anchoring said post to said container, said anchor comprising:

(a) a vehicle tire including:
  i. a tread portion,
  ii. a first sidewall portion joined with said tread portion, and,
  iii. a first hole provided in said first sidewall portion receiving said post of said basketball goal; and (b) said tire encircling said container and said tire having an inside diameter slightly smaller than said outside diameter of said container so that said container is tightly held by said anchor.

7. The combination of claim 6 in which said vehicle tire portion includes a second sidewall portion spaced from said first sidewall portion and joined with said tread portion on the opposite side of said tread portion from said first sidewall portion, and in which said vehicle tire includes a second hole provided in said second sidewall portion in alignment with said first hole and receiving said post of said basketball goal.

8. In combination, a basketball goal including a post, a container, and an anchor for anchoring said post to said container, said anchor comprising:

(a) a vehicle tire including:
  i. a tread portion,
  ii. a first sidewall portion joined with said tread portion,
  iii. a first hole provided in said first sidewall portion,
  iv. a second sidewall portion spaced from said first sidewall portion and joined with said tread portion on the opposite side of said tread portion from said first sidewall portion, and,
  v. a second hole provided in said second sidewall portion in alignment with said first hole;

(b) said container including:
  i. a base having a top surface,
  ii. a projection attached to said top surface and extending upwardly therefrom, said projection being smaller than said base to establish a ledge on said top surface around said projection, and
  iii. a vertically extending recess provided in the front surface of said base;

(c) said tire encircling said projection with said tire resting on said ledge and said tire having an inside diameter slightly smaller than the outside diameter of said projection so that said projection is tightly held by said tire; and (d) said post extending downwardly through said first and second holes in said first and second sidewall portions and through said recess to hold said post securely in a vertical position.

9. A container for use with a tire to anchor the post of a basketball goal, said container comprising:

(a) a base having a top surface, (b) a projection attached to said top surface and extending upwardly therefrom for receiving a tire therearound, said projection being smaller than said base to establish a ledge on said top surface around said projection for providing a place for a tire to rest, and (c) a vertically extending recess provided in the front surface of said base for receiving the post of a basketball goal.

10. The container of claim 9 in which said projection and said base are cylindrical in shape.

11. A vehicle tire for use with a container to anchor the post of a basketball goal, said tire comprising:

(a) a tread portion, (b) a first sidewall portion joined with said tread portion, (c) a first hole provided in said first sidewall portion, (d) a second sidewall portion spaced from said first sidewall portion and joined with said tread portion on the opposite side of said tread portion from said first sidewall portion, and, (e) a second hole provided in said second sidewall portion in alignment with said first hole.

* * * * *